US009545352B2

(12) United States Patent
Flin

(10) Patent No.: US 9,545,352 B2
(45) Date of Patent: Jan. 17, 2017

(54) SECURITY CAP FOR MEMORIAL BLOCK

(71) Applicant: Life Remembrance, LLC, Denver, CO (US)

(72) Inventor: Douglas Lee Flin, Denver, CO (US)

(73) Assignee: Life Remembrance, LLC, Denver, CO (US)

( * ) Notice: Subject to any disclaimer, the term of this patent is extended or adjusted under 35 U.S.C. 154(b) by 0 days.

(21) Appl. No.: 14/276,822

(22) Filed: May 13, 2014

(65) Prior Publication Data

US 2015/0284972 A1 Oct. 8, 2015

Related U.S. Application Data

(60) Provisional application No. 61/974,259, filed on Apr. 2, 2014.

(51) Int. Cl.
*A61G 99/00* (2006.01)
*E04H 13/00* (2006.01)

(52) U.S. Cl.
CPC ..... *A61G 99/00* (2013.01); *E04H 13/008* (2013.01)

(58) Field of Classification Search
CPC ..... E04H 13/001; E06B 7/28
USPC ..... 49/463, 464, 465, 466
See application file for complete search history.

(56) References Cited

U.S. PATENT DOCUMENTS 2,278,451 A 4/1942 Everett
2,534,286 A 12/1950 Maag et al.
2,535,275 A * 12/1950 Dixon ..... E02D 29/1427 220/326
3,731,502 A * 5/1973 Stearns ..... D06B 5/16 68/198
3,869,184 A * 3/1975 Lambert ..... A47B 88/0044 160/216
4,294,049 A * 10/1981 Young et al. ..... 52/20
4,328,606 A 5/1982 Nunes
4,341,436 A * 7/1982 Kanno et al. ..... 359/511
4,761,319 A * 8/1988 Kraus et al. ..... 428/99
4,893,385 A 1/1990 Schrag
5,551,191 A * 9/1996 Maiwandi ..... 49/465
6,047,999 A 4/2000 Dixon
6,167,600 B1 1/2001 Williams et al.
6,219,978 B1 * 4/2001 Wood ..... E06B 9/02 292/149
6,978,579 B1 * 12/2005 Trinca ..... E06B 9/02 49/50
7,469,502 B1 * 12/2008 Steel ..... 49/465
7,647,732 B2 1/2010 Rickards et al.
7,739,776 B2 6/2010 Hume
7,850,751 B2 * 12/2010 Steiner ..... 55/385.1
7,922,033 B2 * 4/2011 Kearby et al. ..... 220/789
8,387,219 B2 3/2013 Rojdev
2007/0084027 A1 4/2007 Walczak
2013/0185907 A1 7/2013 Langelier

* cited by examiner

*Primary Examiner* — Gregory Strimbu

(57) ABSTRACT

An apparatus has at least one fastener and a first plate defining an opening for receiving the at least one fastener and a second plate slidably engaged with the first plate. The second plate defines at least one slot for slidably receiving the at least one fastener. The at least one fastener is adapted to secure the position of the first plate relative to the second plate.

13 Claims, 9 Drawing Sheets

SECURITY CAP FOR MEMORIAL BLOCK

CROSS-REFERENCE TO RELATED APPLICATIONS

This application claims priority to and the benefit of U.S. Provisional Patent Application Ser. No. 61/974,259, filed Apr. 2, 2014, the disclosure of which is hereby incorporated by reference herein in its entirety.

INTRODUCTION

After death, the body of a person may be cremated, and the ashes may be placed into a receptacle such as an urn. Storage options for cremated ashes include placement in a wall of a mausoleum or columbarium, a memorial wall, a freestanding architectural or landscape element, or other structure. Alternatively, the urn may be placed in an urn vault and buried. Regardless of the final storage choice, a hole is typically bored into one side of a concrete, granite, or marble block to form memorial block (or urn vault, if intended for burial). The urn is then placed in the block, and then the block is placed as desired in a final location. Plugging the bore hole is useful to prevent the urn from falling out when setting the block and to secure it to limit vandalism or other damage to the urn. Currently, inelegant procedures exist to plug the bore hole such as caulking the bore or filling the bore with wood shims or other items. These procedures tend to discomfort any bereaved present during the placement of the block and do not offer acceptable methods for securing the urn.

SUMMARY

In one aspect, the technology relates to an apparatus having: at least one fastener; a first plate defining an opening for receiving the at least one fastener; and a second plate slidably engaged with the first plate, wherein the second plate defines at least one slot for slidably receiving the at least one fastener, and wherein the at least one fastener is adapted to secure the position of the first plate relative to the second plate. In an embodiment, the first plate has a base plate and an adjustment plate secured to the base plate, and wherein the adjustment plate defines the at least one slot. In another embodiment, at least one of the first plate and the second plate defines a finger hole. In yet another embodiment, at least one of the first plate and the second plate includes a tab. In still another embodiment, at least one fastener includes a plurality of fasteners and the at least one slot includes a plurality of slots.

In another embodiment of the above aspect, the second plate is secured in a first position, the apparatus defines a round shape, and wherein when the second plate is secured in a second position, the apparatus defines an oblong shape. In an embodiment, the fastener includes at least one of a screw, a bolt, and a rivet. In another embodiment, the first plate defines an opening for receiving a mounting element. In yet another embodiment, the mounting element is the fastener.

In another aspect, the technology relates to a method which includes: placing a security cap in an opening defined by a block, wherein the security cap is inserted while in a first position; spreading a first plate of the security cap away from a second plate of the security cap; and securing the first plate relative to the second plate such that the security cap is held in the opening while in a second position. In an embodiment, the securing operation includes inserting a fastener into an opening defined by at least one of the first plate and the second plate. In another embodiment, the securing operation includes mounting a plaque to the security cap. In yet another embodiment, the spreading operation and securing operation are performed substantially simultaneously.

In yet another aspect, the technology relates to an apparatus having: a first plate; a second plate movably engaged with the first plate; and a fastener for securing a position of the first plate relative to the second plate. In an embodiment, the first plate has a slot and the fastener is disposed within the slot. In another embodiment, the fastener has a deformable pin. In yet another embodiment, the apparatus further includes means for moving the first plate relative to the second plate. In still another embodiment, the means includes at least one of a tab and a finger hole defined by at least one of the first plate and the second plate.

In another embodiment of the above aspect, the means includes a rack and gear. In an embodiment, the means includes the fastener.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
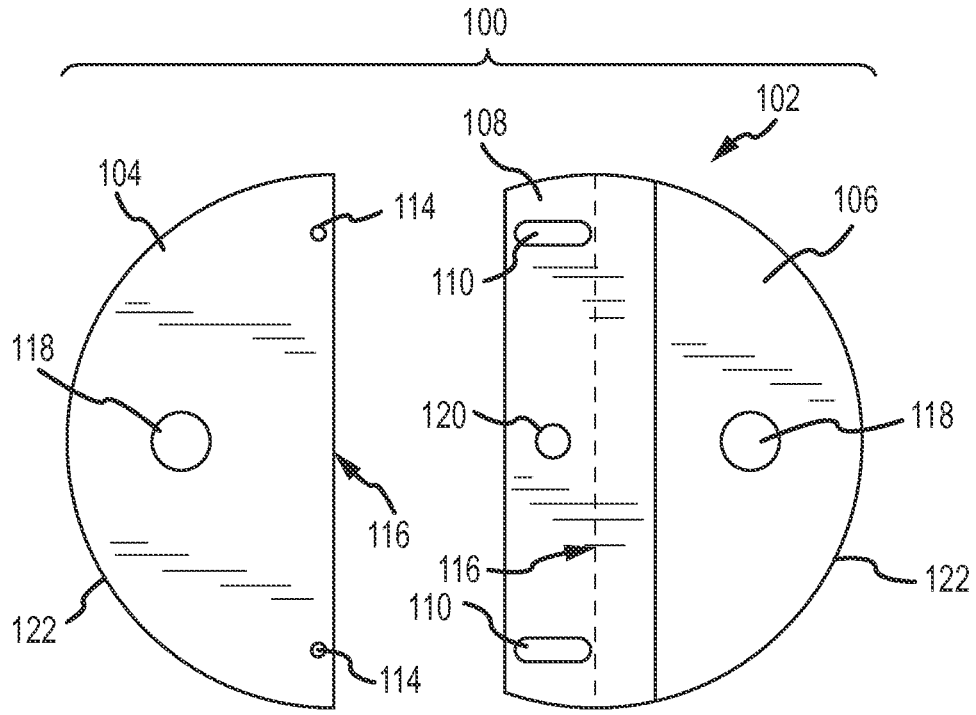
FIGS. 1A and 1B depict exploded top and side views, respectively, of a security cap.
Figure 1B:
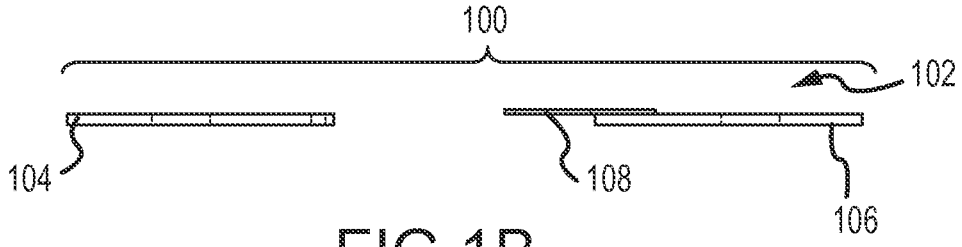

FIGS. 1A and 1B depict top and side views, respectively, of a security cap 100. FIGS. 1A-3B are generally described together. The security cap 100 includes a first plate 102 and a second plate 104 movable relative to the first plate 102. In the embodiment of FIGS. 1A and 1B, the first plate 102 includes a base plate 106 and an adjustment plate 108. The adjustment plate 108 is secured to the base plate 106 as required or desired, depending on the materials used in the manufacture of the security cap 100. Such securement may be accomplished by welding, adhesives, rivets or other mechanical fasteners, or combinations thereof. In other embodiments, the first plate 102 may be a single component. The first plate 102 is generally sized and shaped to accommodate a plurality of slots 110 that each slidably receive a fastener 112, which may be a screw, bolt, rivet, or other fastening device or mechanism. In other embodiments, the slot 110 may be disposed in the second plate 104.

Figure 2A:
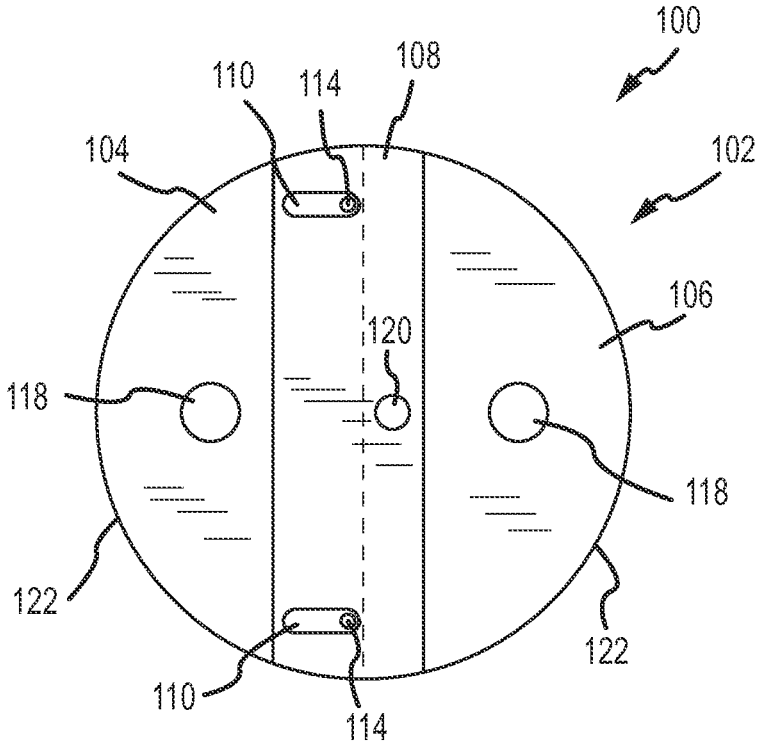
FIGS. 2A and 2B depict top and side views, respectively, of the security cap of FIGS. 1A and 1B, in a first position.
Figure 2B:
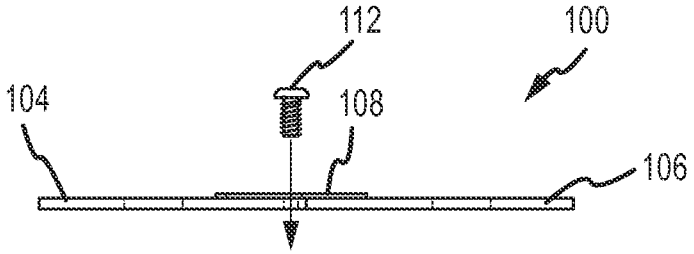
Figure 3A:
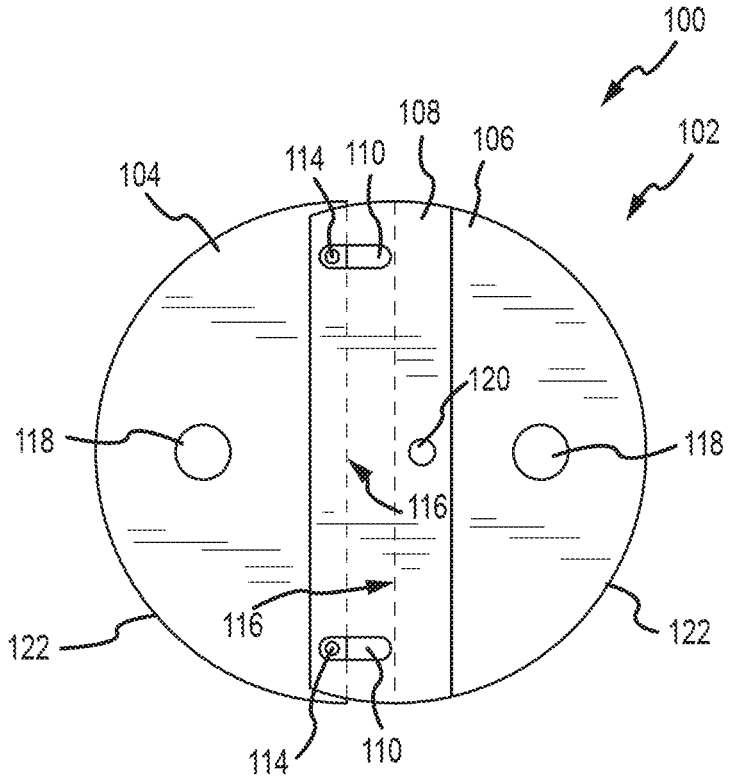
FIGS. 3A and 3B depict top and side views, respectively, of the security cap of FIGS. 1A and 1B, in a second position.
Figure 3B:
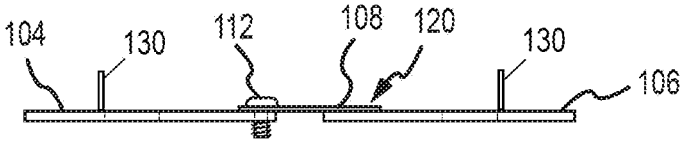

The slots 110 are substantially aligned with corresponding openings 114 defined by the second plate 104. The openings 114 are sized to receive the fastener 112. The second plate 104 may be disposed below the adjustment plate 108 of the first plate 102, such that when central edges 116 of the first plate 102 and second plate 104 are in contact, as depicted, the security cap 100 defines a substantially circular shape, as depicted in FIG. 2A. As can be seen in FIG. 3A, when the second plate 104 is moved away from the first plate 102 (such that the fastener opening 114 is disposed at an opposite end of the slot 110), the security cap 100 defines a second, substantially oblong shape. Finger holes 118 may be defined by either or both of the first plate 102 and the second plate 104. The finger holes 118 enable a user to spread the second plate 104 away from the first plate 102, as described in the installation method below. In an alternative embodiment, tabs 130 extending from the plates may be utilized instead of or in addition to the finger holes. Once the first plate 102 and second plate 104 have been separated away from each other, the fasteners 112 can be adjusted so as to secure the first plate 102 relative to the second plate 104 in the oblong or expanded position. One or more mount openings 120 may be defined by either or both of the first plate 102 and second plate 104. The mount openings 120 may be used to secure a decorative or memorial plaque over the security cap 100. The mount openings 120 may be adapted to receive a screw or bolt, or a pin mounting element. In certain embodiments, the mounting element further prevents movement of the second plate 104 towards the first plate 102, and thus functions similar to the fastener 112. Each plate 102, 104 has outer edges 122 that may be contoured as required or desired for a particular application.

Figure 4A:
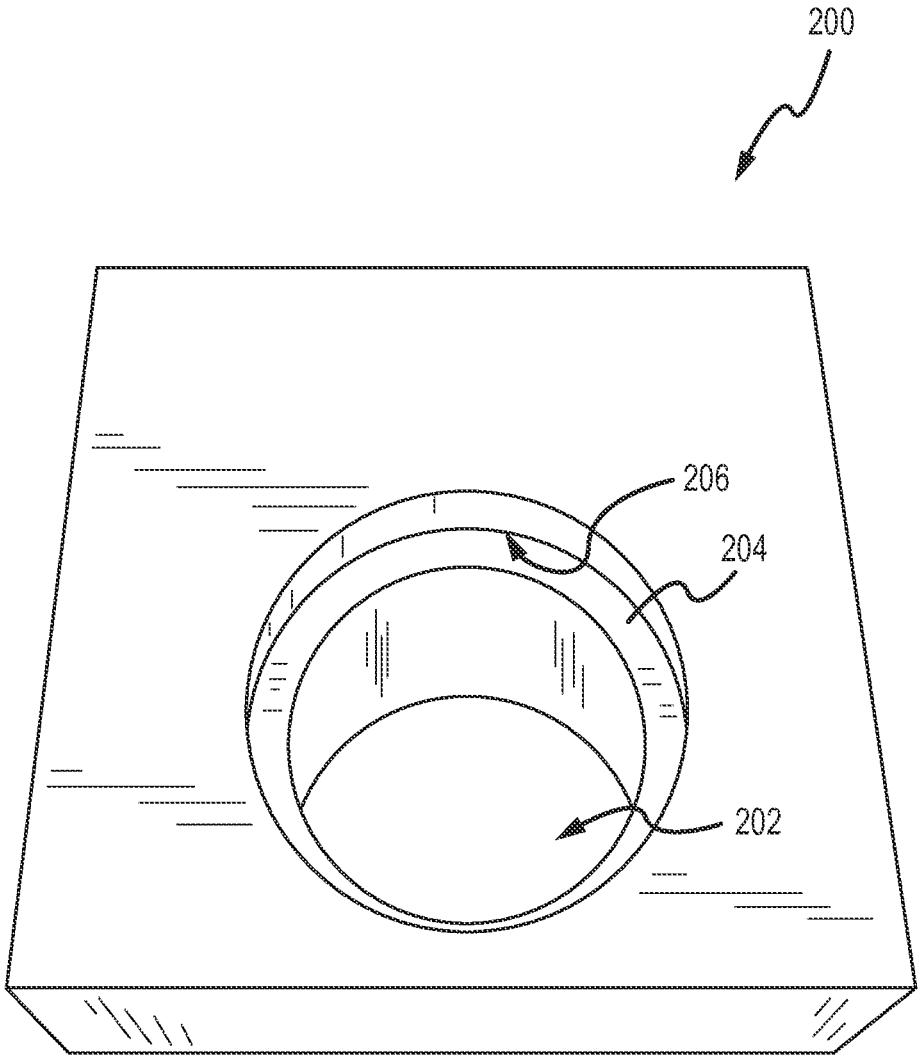
FIG. 4A depicts a first step of a method of installing a security cap in a block.
Figure 4B:
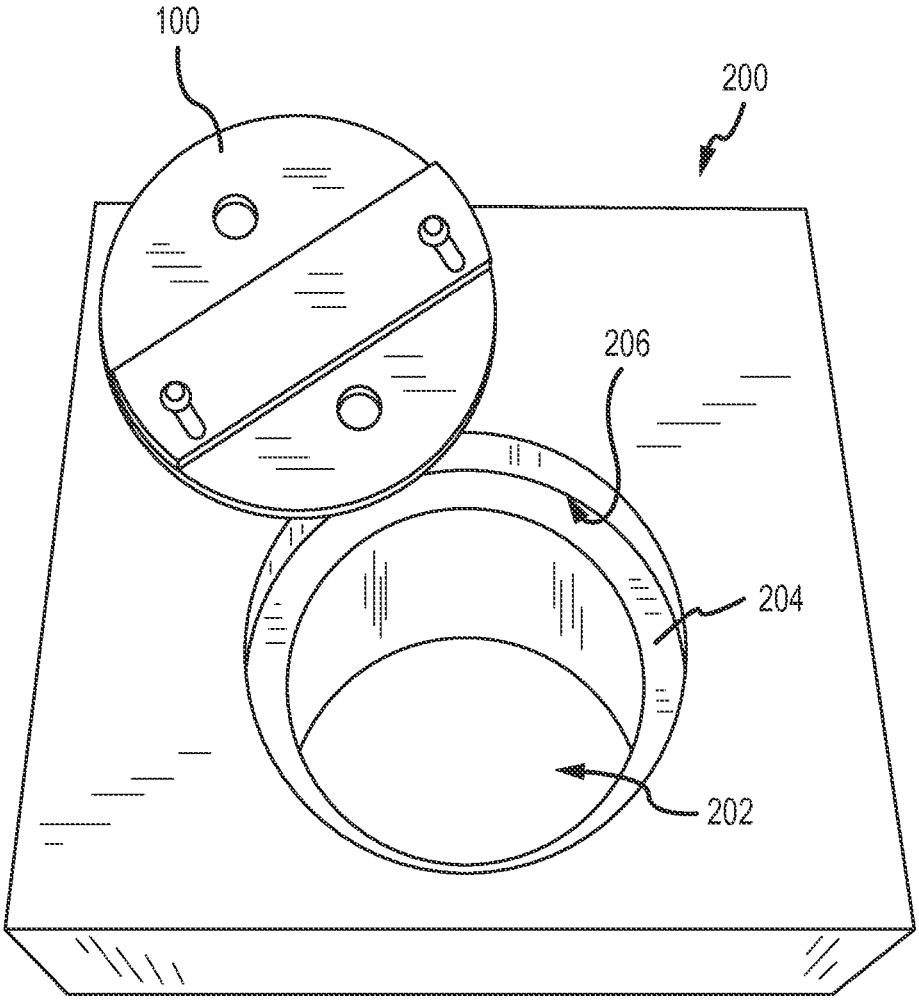
FIG. 4B depicts a second step of the method of installing the security cap in the block.
Figure 4C:
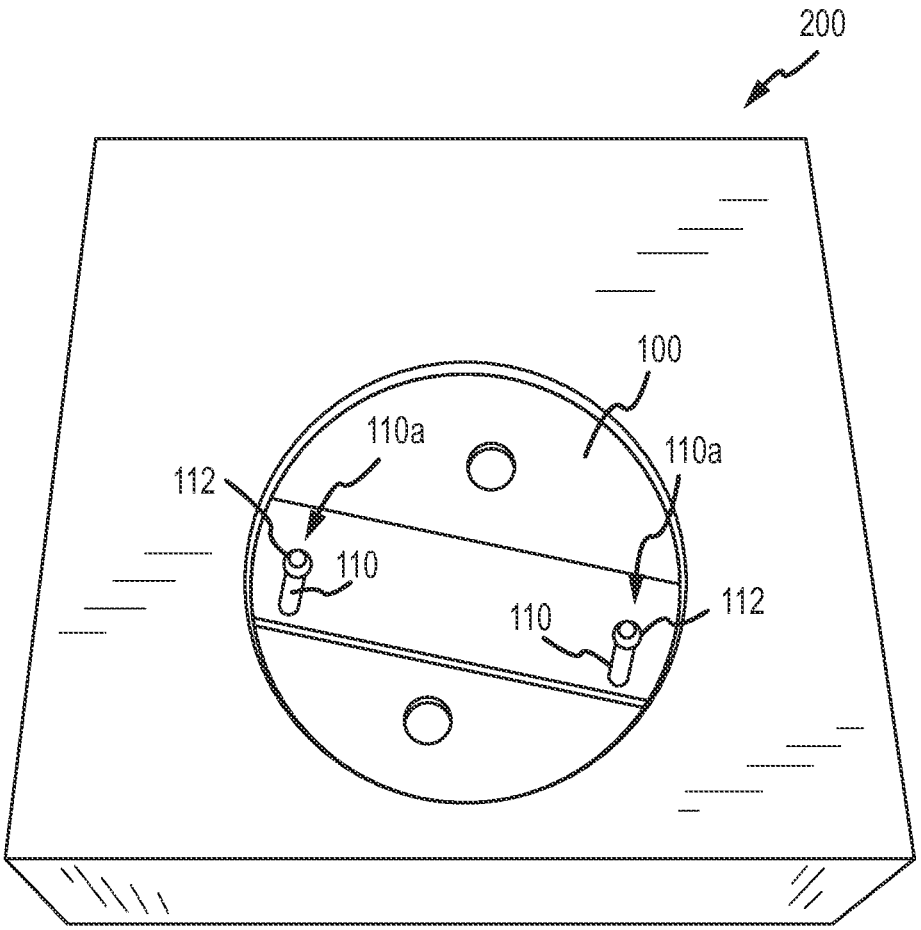
FIG. 4C depicts a third step of the method of installing the security cap in the block.
Figure 4D:
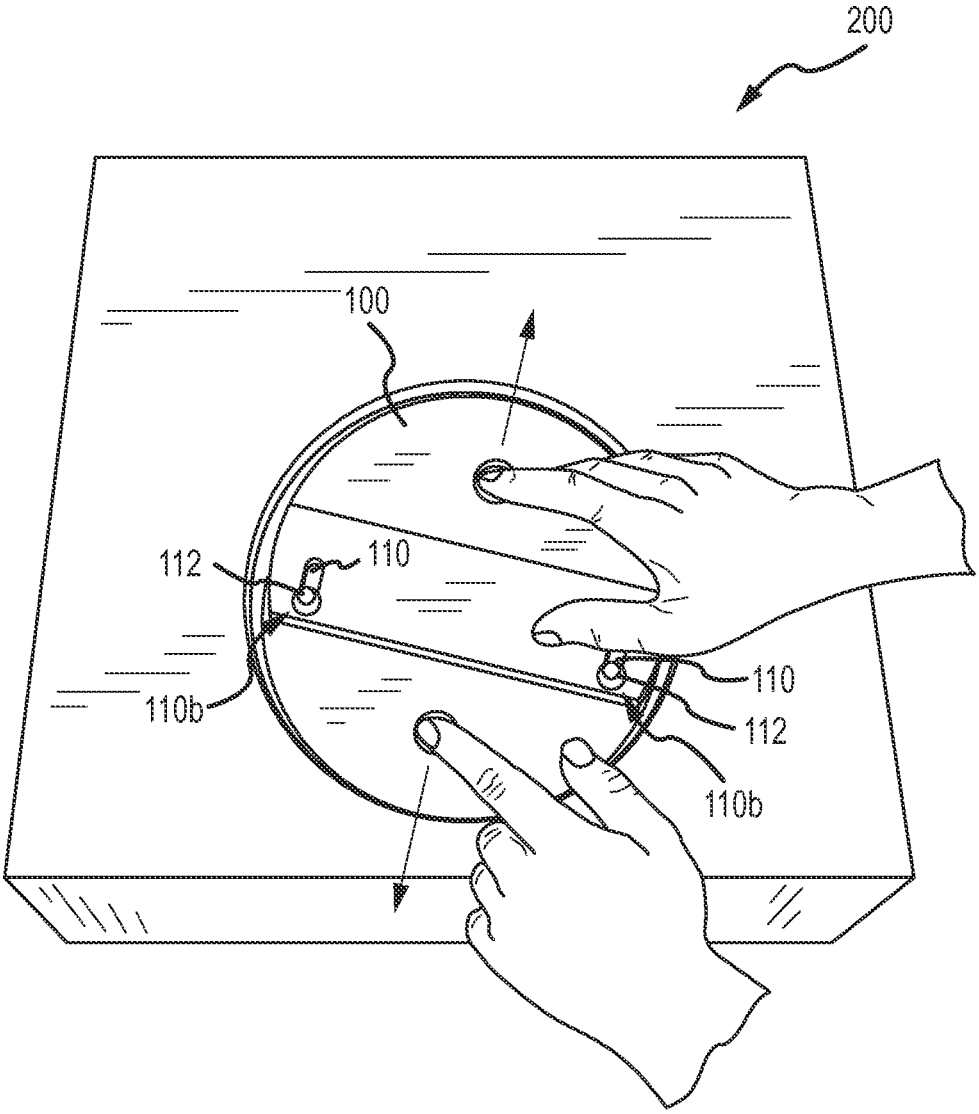
FIG. 4D depicts a fourth step of the method of installing the security cap in the block.

FIGS. 4A-4D depict a method of installing a security cap 100 in a block 200. FIG. 4A depicts a block 200, which may be a block of marble, granite, concrete or other material that may be incorporated into a wall or other structure, or otherwise placed as described above. In other embodiments, the block may have other shapes (e.g., cylindrical, misshapen, etc.). A bore 202 may pass completely or partially through the block. In the depicted embodiment, the bore 202 also defines a rest 204 upon which a security cap 100 may be placed prior to expansion. The bore 202 may define a race or channel 206 about a circumference thereof. The race 206 has a diameter generally greater than the diameter of the bore 202 and is configured to receive an expanded security cap 100, as described below. FIG. 4B depicts the block 200 and a security cap 100. The security cap 100 is configured generally as described above. FIG. 4C depicts the security cap 100 in the bore 202, on the rest 204, prior to expansion. Here, the fasteners 112 are disposed at a first end 110*a* of the slots 110, thus, the security cap 100 is in a first configuration that is substantially circular. FIG. 4D depicts the security cap 100 in a second, expanded configuration that is substantially oblong. Here, the fasteners 112 are at second ends 110*b* of the slots 110. In this position, the curved edges 122 of the first plate 102 and second plate 104 extend into the channel 206 so as to hold the security cap 100 in place. The fasteners 112 can be loosened to allow the security cap 100 to be removed, if required.

Figure 5:
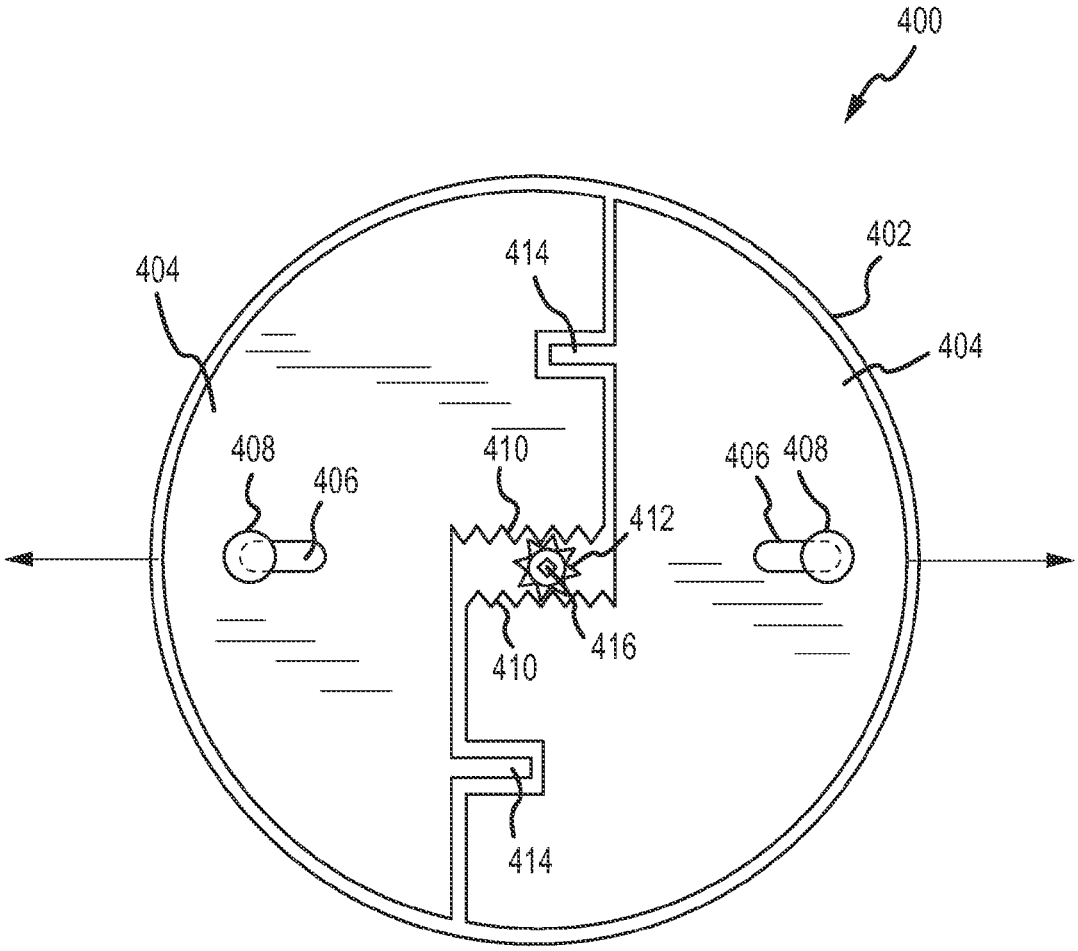
FIG. 5 depicts a bottom view of another embodiment of a security cap.

FIG. 5 depicts a bottom view of another embodiment of a security cap 400. This security cap 400 utilizes a substantially circular baseplate 402 of two substantially identical expanding plates 404. Each expanding plate 404 defines a slot 406. A pin having an enlarged head 408 is connected to the base plate 402. The pin is configured to slide within the slot 406. While the enlarged head 408 prevents the expanding plates 404 from separating from the base plate 402. Each expanding plate 404 defines a centrally-disposed rack 410 and a gear 412 is disposed therebetween. The gear 412 is rotatably connected to the base plate 402. Counter-clockwise rotation of the gear 410 expands the plates 404 away from each other. Guides 414 may be disposed in either or both of the expanding plates 404 to ensure an even separation. Once expanded into a bore channel (as described above), the gear 410 acts also as a fastener 112, preventing the expanding plates 404 from moving toward each other, unless the gear 410 is actively turned in a clockwise direction. The gear 410 may also define a mount opening 416 for receiving a mounting element, as described above.

Figure 6:
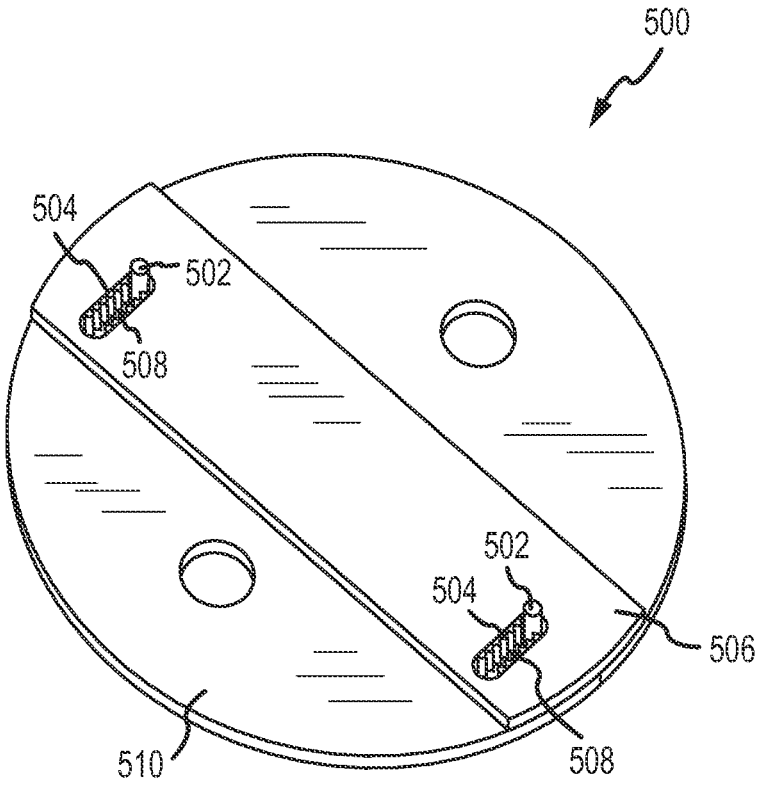
FIG. 6 depicts a partial enlarged sectional view of another embodiment of a security cap.

FIG. 6 depicts a partial enlarged view of another embodiment of a security cap 500. The security cap 500 includes a pin 502 that extends from a first plate 510. The pin 502 is disposed in a slot 504 defined by a second plate 506. The slot 504 defines a plurality of teeth or detents 508. The pin 502 may be manufactured of an elastically deformable material such that the pin 502 may be moved along the slot 504, throughout a plurality of positions, when acted upon by a sufficient force (typically by a user engaging the finger holes or tabs so as to spread the first plate from the second plate 506) as described herein. In the absence of that force, however, the pin 502 will hold the first plate relative to the second plate 506 due to the interaction with the detents 508. Thus, in this configuration, the pin 502 and detents 508 act as the fasteners described herein.

The various components of the security caps depicted herein may be manufactured of any materials typically used in outdoor or indoor construction. Such materials include, but are not limited to, cast or machined steel, stainless steel, brass, aluminum, etc. Additionally, high-impact plastics such as ABS, HDPE, PVC, and others, may be utilized. Material selection may be based, in part, on the environment in which the block is to be placed. For example, it may be desirable to utilize weather resistant components such as stainless steel or aluminum in blocks exposed to elements. Other considerations for material selection include material compatibility, manufacturing costs, product costs, etc. Other shapes of caps are also contemplated, depending on the shape of the bore.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured all such modifications as fall within the spirit and scope of the technology. Accordingly, what is desired to be secured by Letters Patent is the technology as defined and differentiated herein, and all equivalents.

What is claimed is:

1. An apparatus comprising:

at least one fastener;

a plate element comprising a base plate and an adjustment plate parallel to and fixed to the base plate so as not to move relative to the base plate, wherein the adjustment plate defines a slot opening for slidably receiving the at least one fastener, and wherein the base plate comprises an inner edge extending substantially entirely along a length of the adjustment plate; and a third plate slidably engaged with and parallel to the adjustment plate between a first position and a second position, wherein the third plate comprises an inner edge and defines an opening for receiving the at least one fastener, and wherein the at least one fastener selectively secures the adjustment plate to the third plate, and wherein the third plate is coplanar with the base plate and non-coplanar with the adjustment plate such that the third plate inner edge faces the base plate inner edge so as to contact the base plate inner edge in the first position and not contact the base plate inner edge in the second position.

2. The apparatus of claim 1, wherein at least one of the base plate and the third plate defines a finger hole.

3. The apparatus of claim 1, wherein at least one of the base plate and the third plate includes a tab.

4. The apparatus of claim 1, wherein the at least one fastener comprises a plurality of fasteners and the slot comprises a plurality of slots.

5. The apparatus of claim 1, wherein when the third plate is selectively secured to the adjustment plate in the first position, the apparatus defines a round shape, and wherein when the third plate is selectively secured to the adjustment plate in the second position, the apparatus defines an oblong shape.

6. The apparatus of claim 1, wherein the fastener comprises at least one of a screw, a bolt, and a rivet.

7. The apparatus of claim 1, wherein the plate element defines an opening for receiving a mounting element.

8. The apparatus of claim 1, wherein the base plate and the adjustment plate are a single component.

9. The apparatus of claim 1, wherein the fastener comprises a deformable pin.

10. The apparatus of claim 1, wherein the apparatus further comprises means for moving the base plate relative to the third plate.

11. The apparatus of claim 10, wherein the means comprises a rack and gear.

12. The apparatus of claim 10, wherein the means comprises the fastener.

13. The apparatus of claim 10, wherein the means comprises at least one of a tab and a finger hole defined by at least one of the base plate and a the third plate.

* * * * *